US008430729B2

(12) United States Patent
Nakamoto et al.

(10) Patent No.: US 8,430,729 B2
(45) Date of Patent: Apr. 30, 2013

(54) COIN HANDLING MACHINE

(75) Inventors: Tasuku Nakamoto, Hyogo (JP); Tomoyuki Kubo, Hyogo (JP)

(73) Assignee: Glory Ltd., Himeji-Shi, Hyogo (JP)

( * ) Notice: Subject to any disclaimer, the term of this patent is extended or adjusted under 35 U.S.C. 154(b) by 148 days.

(21) Appl. No.: 12/736,313

(22) PCT Filed: Apr. 25, 2008

(86) PCT No.: PCT/JP2008/058018
§ 371 (c)(1),
(2), (4) Date: Sep. 27, 2010

(87) PCT Pub. No.: WO2009/130783
PCT Pub. Date: Oct. 29, 2009

(65) Prior Publication Data
US 2011/0021126 A1 Jan. 27, 2011

(51) Int. Cl.
*G07D 9/06* (2006.01)
*B65B 57/10* (2006.01)
*B65B 57/20* (2006.01)

(52) U.S. Cl.
USPC ..... 453/59; 453/58; 53/54; 53/501; 53/532; 194/217

(58) Field of Classification Search ..... 453/58, 453/59, 61; 194/200, 215, 216, 217; 235/144 R, 235/145 R, 379; 53/52, 53, 54, 55, 56, 57, 53/204, 254, 501
See application file for complete search history.

(56) References Cited

U.S. PATENT DOCUMENTS 7,886,890 B2 * 2/2011 Blake et al. ..... 194/347

FOREIGN PATENT DOCUMENTS

| | | |
|---|---|---|
| JP | 02-300888 | * 12/1990 |
| JP | 07-066464 | 3/1995 |
| JP | 2005-215778 | 8/2005 |

* cited by examiner

*Primary Examiner* — Mark Beauchaine
(74) *Attorney, Agent, or Firm* — Renner, Kenner, Greive, Bobak, Taylor & Weber

(57) ABSTRACT

The present invention provides a coin handling machine the handling efficiency of which can be improved.
On an operation unit 14, either a normal counting mode or a continuous counting mode is selected. Coins are counted by a count processing unit. A count abnormality in the count processing unit is detected by an abnormality detecting unit 68. In a case where a count abnormality is detected by the abnormality detecting unit 68 during count processing, when the normal counting mode is selected, a coin count value is cleared and a quantity error is prevented. In the case where a count abnormality is detected by the abnormality detecting unit 68 during count processing, when the continuous counting mode is selected, the coin count value is held, so that continuous processing is performed even if a count error occurs, so that the handling efficiency is improved.

10 Claims, 8 Drawing Sheets

COIN HANDLING MACHINE

TECHNICAL FIELD

The present invention relates to a coin handling machine which handles coins.

BACKGROUND ART

Conventionally, as a coin handling machine, for example, there is a coin wrapping machine which wraps coins. In this coin wrapping machine, a predetermined number of coins, for example, 50 coins are stacked in a stacking unit, and stacked coins stacked in the stacking unit are moved downward to a wrapping unit below, and in the wrapping unit, the stacked coins are wrapped in wrapping paper, and it is detected whether the number of stacked coins is as predetermined, that is, whether the number of wrapped coins is excessive/deficient. In order to detect excess/deficiency of the number of stacked coins, a structure is used which detects a relative movement amount of upper and lower crimping hooks when they crimp both ends of the wrapping paper wrapped around the stacked coins as a rotation amount by a rotary encoder via an interlocking mechanism using a rack and a pinion, and based on whether the rotation amount is more or less than a rotation amount obtained when the predetermined number of coins are stacked, detects excess/deficiency of the number of wrapped coins (for example, refer to Patent Document 1).

Some coin wrapping machines have a counting and bagging function to count a predetermined number of coins and discharge the coins into a bag in addition to the coin wrapping function. In such a coin wrapping machine, coins are counted and dispensed into a bag, and when a predetermined number of coins are counted, the next coin is stopped by a stopper, and the predetermined number of coins are bagged (for example, refer to Patent Document 2).

Patent Document 1: Japanese Published Unexamined Utility Model Application No. 64-35808 (page 1)

Patent Document 2: Japanese Patent Publication No. 7-66464 (page 4, FIG. 1)

DISCLOSURE OF THE INVENTION

Problem to be Solved by the Invention

At the time of wrapping coins, when excess/deficiency of the number of stacked coins is detected, generally, it is determined that the wrapped coins are not normal, and the wrapped coins consisting of an excessive/deficient number are ejected to a reject box. The wrapped coins, therefore, must be taken out from the reject box and re-wrapped.

During counting and bagging processing, when a coin cannot be stopped by the stopper after a predetermined number of coins are counted, coins after exceeding the predetermined number are generally dispensed into a bag and this is determined as an error, and the bagged coins must be counted again.

With this coin handling machine, when excess/deficiency of the number of stacked coins is detected, the coins must be re-wrapped, and when a count error occurs, recounting is required. Such a time-consuming machine is not suitable for the market where numerous coins are handled and the handling efficiency is emphasized.

The present invention has been made in view of these circumstances, and an object thereof is to provide a coin handling machine the handling efficiency of which can be improved.

Means to Solve the Problems

A coin handling machine includes a count processing unit which counts coins, an abnormality detecting unit which detects a count abnormality in the count processing unit, an operation unit which selects either a normal counting mode or a continuous counting mode, and a control unit which, in a case where a count abnormality is detected by the abnormality detecting unit during count processing by the count processing unit, causes the count processing unit to clear a coin count value counted by the count processing unit when the normal counting mode is selected, and causes the count processing unit to hold a coin count value counted by the count processing unit when the continuous counting mode is selected.

A coin handling machine includes a count processing unit which counts coins, an abnormality detecting unit which detects a count abnormality in the count processing unit, a display unit which displays whether continuous counting is to be performed, an operation unit which instructs whether continuous counting is to be performed, and a control unit which, in a case where a count abnormality is detected by the abnormality detecting unit during count processing by the count processing unit, causes the display unit to display whether continuous counting is to be performed, and causes the count processing unit to clear a coin count value counted by the count processing unit when continuous counting is not instructed by the operation unit, and holds a coin count value counted by the count processing unit when the continuous counting is instructed by the operation unit.

A coin handling machine includes a count processing unit which counts coins, an abnormality detecting unit which detects a count abnormality in the count processing unit, an operation unit which selects either a normal counting mode or a continuous counting mode, and a control unit which, in a case where a count abnormality is detected by the abnormality detecting unit during count processing by the count processing unit, causes the count processing unit to clear a coin count value counted by the count processing unit when the normal counting mode is selected, and causes the count processing unit to hold a coin count value counted by the count processing unit when the continuous counting mode is selected, wherein the control unit causes the count processing unit to stop count processing when an abnormality is detected by the abnormality detecting unit when either the normal counting mode or the continuous counting mode is selected.

A coin handling machine includes a count processing unit which counts coins, an abnormality detecting unit which detects a count abnormality in the count processing unit, an operation unit which selects either a normal counting mode or a continuous counting mode, and a control unit which, in a case where a count abnormality is detected by the abnormality detecting unit during count processing by the count processing unit, causes the count processing unit to clear a coin count value counted by the count processing unit when the normal counting mode is selected, and causes the count processing unit to hold a coin count value counted by the count processing unit when the continuous counting mode is selected, wherein the operation unit includes a start button, and the control unit causes the count processing unit to restart count processing in response to an operation of the start button when the continuous counting mode is selected.

A coin handling machine includes a count processing unit which counts coins, an abnormality detecting unit which detects a count abnormality in the count processing unit, an operation unit which selects either a normal counting mode or a continuous counting mode, and a control unit which, in a case where a count abnormality is detected by the abnormality detecting unit during count processing by the count processing unit, causes the count processing unit to clear a coin count value counted by the count processing unit when the normal counting mode is selected, and causes the count processing unit to hold a coin count value counted by the count processing unit when the continuous counting mode is selected, wherein the control unit causes a processing speed of the count processing unit when the continuous counting mode is selected to be higher than a processing speed of the count processing unit when the normal counting mode is selected.

A coin handling machine includes a count processing unit which counts coins, an abnormality detecting unit which detects a count abnormality in the count processing unit, an operation unit which selects either a normal counting mode or a continuous counting mode, and a control unit which, in a case where a count abnormality is detected by the abnormality detecting unit during count processing by the count processing unit, causes the count processing unit to clear a coin count value counted by the count processing unit when the normal counting mode is selected, and causes the count processing unit to hold a coin count value counted by the count processing unit when the continuous counting mode is selected, further comprising a printing unit which issues a receipt, and the control unit causes the printing unit, after count processing in the continuous counting mode is finished, to issue a receipt on which the printing unit prints that the continuous counting mode is selected.

A coin handling machine includes a wrapping processing unit which wraps coins, an abnormality detecting unit which detects an abnormal number of wrapped coins wrapped by the wrapping processing unit, an operation unit which selects either a normal wrapping mode or a continuous wrapping mode, and a control unit which, in a case where an abnormal number of wrapped coins is detected by the abnormality detecting unit, causes the wrapping processing unit to eject the wrapped coins consisting of the abnormal number of coins when the normal wrapping mode is selected, and causes the wrapping processing unit to continue wrapping processing when the continuous wrapping mode is selected.

A coin handling machine includes a wrapping processing unit which wraps coins, an abnormality detecting unit which detects an abnormal number of wrapped coins wrapped by the wrapping processing unit, an operation unit which selects either a normal wrapping mode or a continuous wrapping mode, and a control unit which, in a case where an abnormal number of wrapped coins is detected by the abnormality detecting unit, causes the wrapping processing unit to eject the wrapped coins consisting of the abnormal number of coins when the normal wrapping mode is selected, and causes the wrapping processing unit to continue wrapping processing when the continuous wrapping mode is selected, wherein the control unit disables detection of the abnormality detecting unit when the continuous wrapping mode is selected.

A coin handling machine includes a wrapping processing unit which wraps coins, an abnormality detecting unit which detects an abnormal number of wrapped coins wrapped by the wrapping processing unit, an operation unit which selects either a normal wrapping mode or a continuous wrapping mode, and a control unit which, in a case where an abnormal number of wrapped coins is detected by the abnormality detecting unit, causes the wrapping processing unit to elect the wrapped coins consisting of the abnormal number of coins when the normal wrapping mode is selected, and causes the wrapping processing unit to continue wrapping processing when the continuous wrapping mode is selected, further comprising a wrapping paper printing unit which performs printing on wrapping paper for wrapping the coins, and the control unit causes the wrapping paper printing unit to print that the continuous wrapping mode is selected, on the wrapping paper for wrapping coins in the continuous wrapping mode.

Effects of the Invention

A the coin handling machine of the present invention is configured, such that when a count abnormality is detected during count processing, and if the normal counting mode has been selected, the coin count value is cleared and a quantity error can be prevented, and if the continuous counting mode has been selected, the coin count value is held and continuous processing is enabled even if a count error occurs, so that the handling efficiency is improved, and accordingly, diverse demands of the market can be satisfied.

A coin handling machine of the present invention is configured, such that in a case where a count abnormality is detected during count processing, the display unit is caused to display whether continuous counting is to be performed, and when the operation unit instructs not to perform continuous counting, the coin count value is cleared and a quantity error can be prevented, and when the operation unit instructs to continue counting, the coin count value is held and continuous processing is enabled even if a count error occurs, so that the handling efficiency is improved, and accordingly, diverse demands of the market can be satisfied.

The coin handling machine of the present invention is configured, such that when either the normal counting mode or continuous counting mode is selected, and if an abnormality is detected, the count processing can be stopped and the abnormality can be confirmed.

The coin handling machine of the present invention is configured, such that when the continuous counting mode is selected, count processing can be easily restarted by operation of the start button.

The coin handling machine of the present invention is configured, such that the processing speed of the count processing unit when the continuous counting mode is selected can be made higher than the processing speed of the count processing unit when the normal counting mode is selected, so that the handling efficiency is improved.

The coin handling machine of the present invention is configured, such that after count processing in the continuous counting mode is finished, a receipt on which the printing unit prints that the continuous counting mode is selected can be issued by the printing unit and attached to the counted coins, so that the possibility of a quantity error can be indicated.

A With the coin handling machine of the present invention is configured, such that when an abnormal number of wrapped coins is detected, and if the normal wrapping mode has been selected, the wrapped coins consisting of the abnormal number of coins are ejected and a quantity error can be prevented, and if the continuous wrapping mode has been selected, wrapping processing is continued, so that the handling efficiency is improved, and accordingly, diverse demands of the market can be satisfied.

The coin handling machine of the present invention is configured, such that when the continuous wrapping mode is selected, detection by the abnormality detecting unit is disabled and wrapping processing can be continued.

The coin handling machine of the present invention is configured, such that by the printing unit printing that the continuous wrapping mode is selected on the wrapping paper for wrapping coins in the continuous wrapping mode by the wrapping paper printing unit, the possibility of an abnormal number of wrapped coins can be indicated.

REFERENCE NUMERALS

Figure 1:
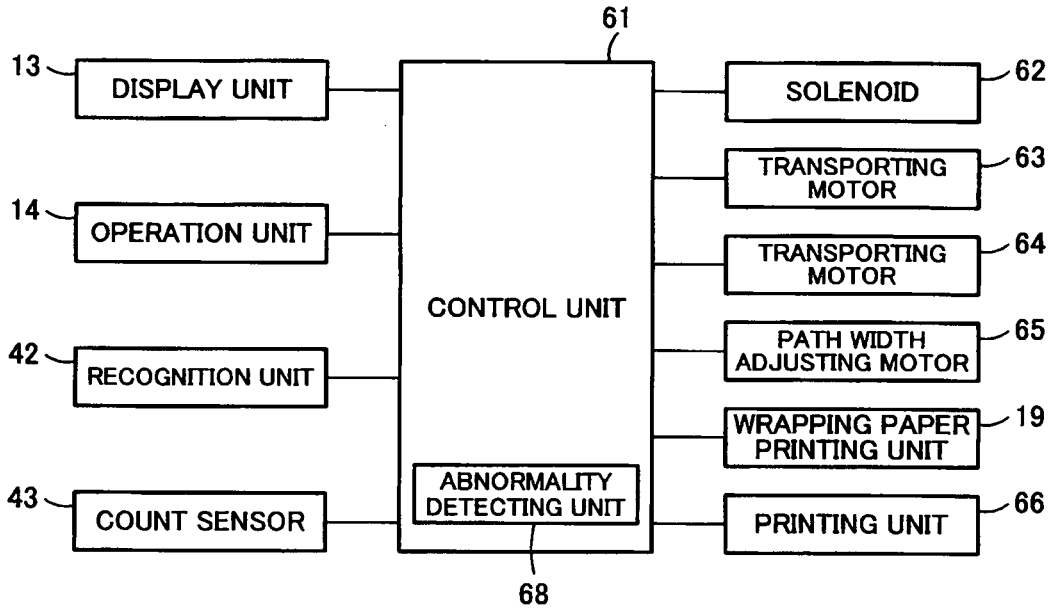
FIG. 1 is a block diagram of a coin handling machine showing an embodiment of the present invention.

13 Display unit
14 Operation unit
19 Wrapping paper printing unit
27 Count processing unit.
28 Wrapping processing unit
61 Control unit
66 Printing unit
68 Abnormality detecting unit

BEST MODE FOR CARRYING OUT THE INVENTION

Hereinafter, an embodiment of the present invention will be described with reference to the drawings.

Figure 4:
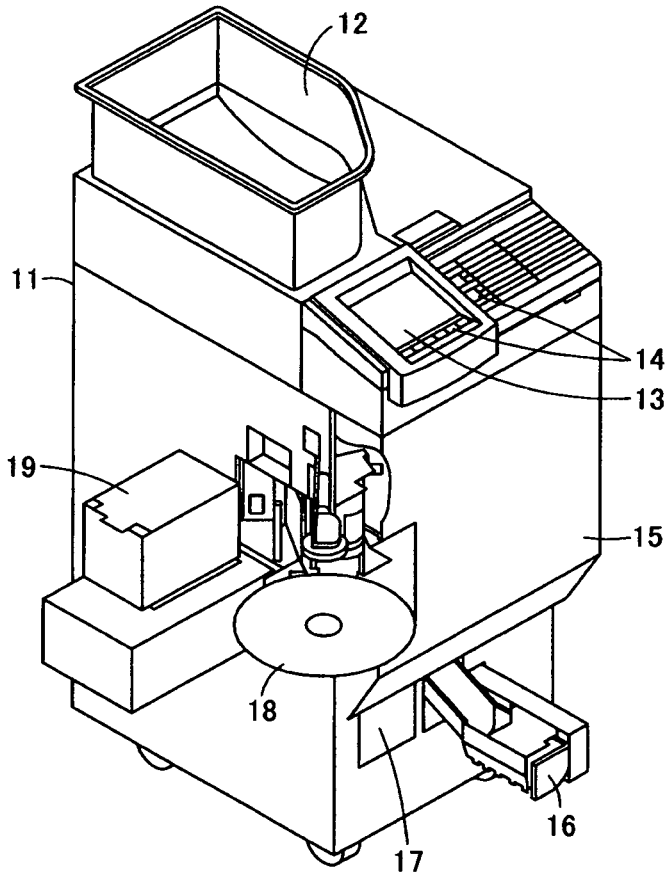
FIG. 4 is a perspective view of the same coin handling machine.

FIG. 4 shows a coin wrapping machine as a coin handling machine.

This coin wrapping machine includes, on an upper portion of the machine body 11, a hopper 12 into which coins to be handled are input, a display unit 13 which displays various indications, and an operation unit 14 which performs various operations.

On the front face of the machine body 11, a door body 15 is arranged so as to open and close, and below the door body 15, a wrapped coin dispensing unit 16 which dispenses wrapped coins to the outside and an ejecting unit 17 which stores wrapped coins consisting of an excessive/deficient number of coins are disposed.

On a side portion of the machine body 11, a wrapping paper supply base 18 on which rolled wrapping paper for wrapping coins is arranged and which supplies the wrapping paper into the wrapping unit inside the machine body 11, and a wrapping paper printing unit 19 which performs printing on the wrapping paper, etc., are disposed.

Figure 2:
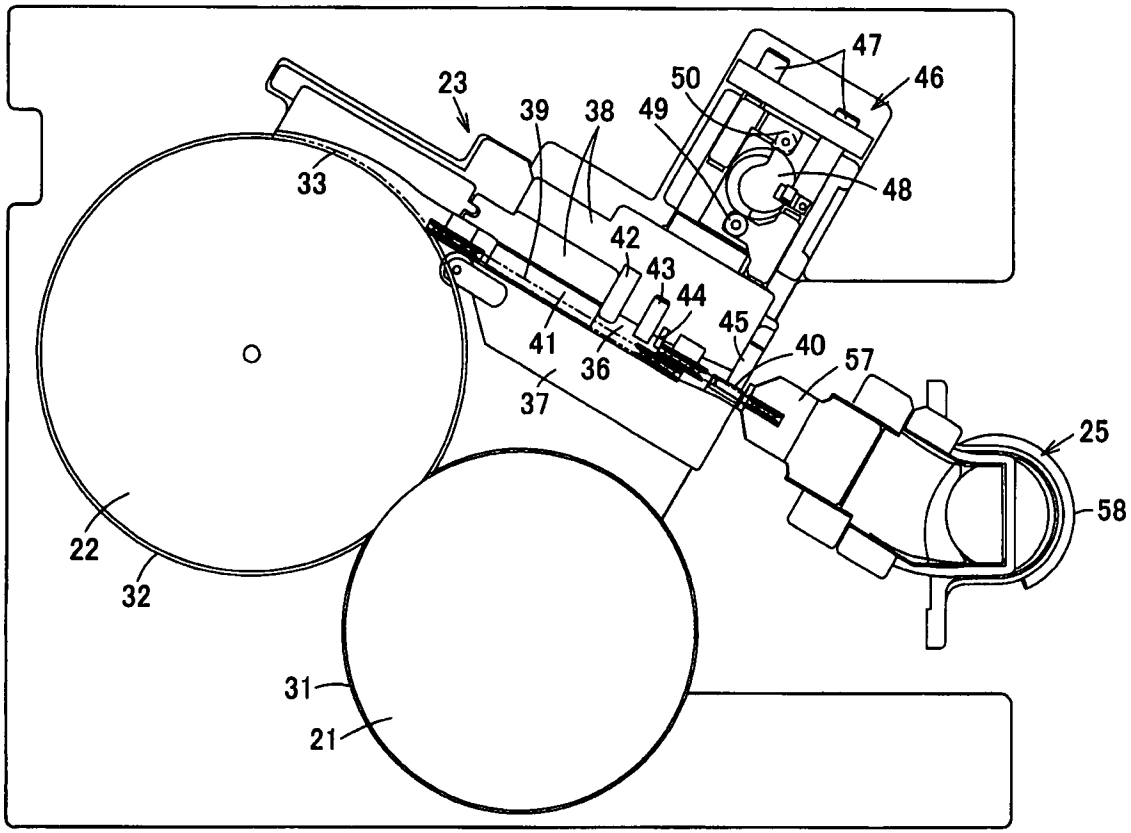
FIG. 2 is a plan view showing a count processing unit of the same coin handling machine.
Figure 3:
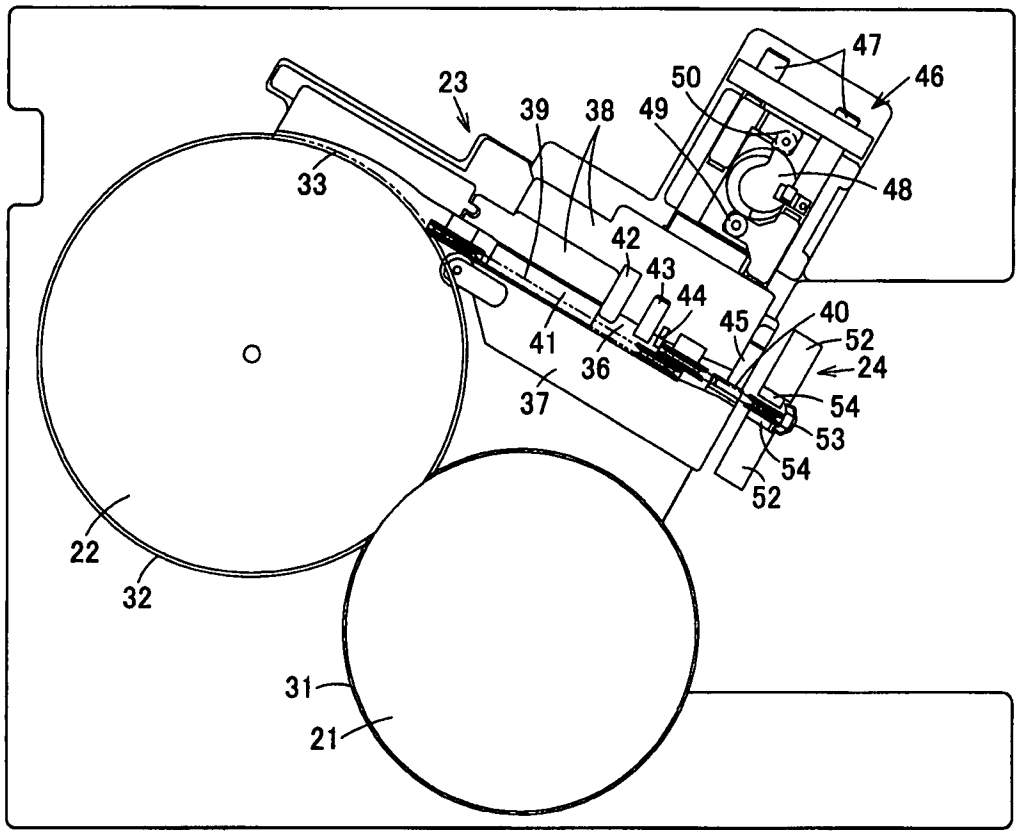
FIG. 3 is a plan view showing a wrapping processing unit of the same coin handling machine.

Next, FIG. 2 and FIG. 3 show a coin handling mechanism arranged inside the machine body 11. FIG. 2 mainly shows a count processing unit and FIG. 3 mainly shows a wrapping processing unit.

This coin handling mechanism includes a supplying centrifugal disk 21 which receives coins input into the hopper 12, a centrifugal disk 22 which receives coins supplied from the supplying centrifugal disk 21, and a path unit 23 which receives coins fed out one by one from the centrifugal disk 22 in a tangential direction of the centrifugal disk 22 and transports the coins. At the terminal end of the path unit 23, a stacking unit 24 in which coins are stacked is disposed, and below the stacking unit 24, a wrapping unit not shown which wraps stacked coins is disposed. Further, at the terminal end of the path unit 23, a bagging unit 25 is disposed which receives coins ejected from the terminal end of the path unit 23 as a substitute for the stacking unit 24 and stores the coins in a bag not shown.

The centrifugal disks 21 and 22, the path unit 23, and the bagging unit 25, etc., constitute a count processing unit 27 which counts coins, and the centrifugal disks 21 and 22, the path unit 23, the stacking unit 24, and the wrapping unit, etc., constitute a wrapping processing unit 28 which wraps coins.

On the periphery of the centrifugal disk 21, a peripheral wall 31 is provided, and through an opening opened in a part of the peripheral wall 31, coins are supplied from the centrifugal disk 21 to the centrifugal disk 22.

On the periphery of the centrifugal disk 22, a peripheral wall 32 is provided, and through a clearance between the lower side of a thickness restricting member 33 constituting a part of the peripheral wall 32 and the upper surface of the centrifugal disk 22, coins are fed out in a single-layered state from the centrifugal disk 22 to the path unit 23.

The path unit 23 includes a path bottom plate 36 arranged to be flush with the upper surface of the centrifugal disk 22, and movable path members 37 and 38 arranged movably in the path width direction on one side and the other side of the path bottom plate 36. Above the path unit 23, an upstream side transporting belt 39 and a downstream side transporting belt 40 which transport coins in the path unit 23 toward the downstream side are disposed.

Inside the path unit 23, in order from the upstream side in the transporting direction, an ejecting hole 41 for ejecting coins with diameters smaller than that of a handling target denomination for which a path width has been adjusted, a recognition unit 42 which recognizes coins, a count sensor 43 which counts coins, a stopper 44 which stops coins, and a confirmation sensor 45 for confirming coins ejected from the terminal end of the path unit 23 are disposed.

The path width between the movable path members 37 and 38 on both sides is adjusted by a path width adjusting unit 46 according to a denomination to be handled. This path width adjusting unit 46 supports the movable path members 37 and 38 slidably in the path width direction by a plurality of axes 47, and a path width adjusting cam 48 is disposed outside the movable path member 38, and bearings 49 and 50 joined to the movable path members 37 and 38 are brought into contact with both sides of the path width adjusting cam 48 corresponding to the path width direction. By moving the movable path members 37 and 38 in the path width direction by turning the path width adjusting cam 48 according to a denomination to be handled, the path width can be adjusted.

The stacking unit 24 includes a pair of stacking belts 52 which face each other on both sides in the path width direction at the terminal end of the path unit 23 and are rotatable in the up-down direction, and stack coins, and a stacking guide 53 which holds coins ejected from the terminal end of the path unit 23 at a position between the pair of stacking belts 52. On the surfaces of the pair of stacking belts 52, coin support units 54 on which coins are placed and stacked project. By rotating the pair of stacking belts 52 so that the coin support units 54 move down by only one coin each time a coin ejected from the path unit 23 is stacked on the coin support units 54 of the pair of stacking belts 52, a predetermined number of coins are stacked. The stacked coins are moved to the wrapping unit below.

The wrapping unit prepares wrapped coins by wrapping the wrapping paper around the stacked coins and crimping both ends of the wrapping paper around end faces of the stacked coins. The wrapping unit includes a number-of-coins detecting mechanism not shown which detects the number of wrapped coins.

The bagging unit 25 includes a receiving chute 57 which receives coins ejected from the terminal end of the path unit 23. This receiving chute 57 can move to a portion above the stacking unit 24 at the time of count processing, and retract from the portion above the stacking unit 24 at the time of wrapping processing.

The receiving chute 57 is connected to a cylindrical bag fitting portion 58 to which a bag for storing coins is removably fitted and guides coins received by the receiving chute 57 into the bag fitting portion 58, and the coins can be stored in the bag.

Next, FIG. 1 shows a control unit 61 which controls the coin wrapping machine.

To this control unit 61, the display unit 13, the operation unit 14, the recognition unit 42, the count sensor 43, a solenoid 62 as a stopper driving unit for protruding and retracting the stopper 44 into and from the path, a transporting motor 63 which drives the transporting belt 39, a transporting motor 64 which drives the transporting belt 40, a path width adjusting motor 65 which turns the path width adjusting cam 48, a wrapping paper printing unit 19 which performs printing on the wrapped coins, and a printing unit 66 which issues a receipt, are connected.

The display unit 13 displays various indications associated with processing, including an indication showing whether continuous counting is to be performed.

The operation unit 14 can select either a normal counting mode or a continuous counting mode for count processing, and can select either a normal wrapping mode or a continuous wrapping mode for wrapping processing. Further, the operation unit 14 includes various buttons such as a start button and a stop button, and can instruct a denomination to be counted, the number of coins to be counted, a denomination to be wrapped, and whether continuous counting is to be performed.

The control unit 61 has the following functions.

A function as a storage unit which counts the number of coins based on detection by the count sensor 43.

A function as an abnormality detecting unit 68 which detects a count abnormality in the count processing unit 27 based on detections by various sensors including the count sensor 43 during count processing, and detects an abnormal number of wrapped coins wrapped by the wrapping processing unit 28 based on detection by the number-of-coins detecting mechanism during wrapping processing.

A function to perform a first count operation in which, during count processing by the count processing unit 27, in a case where a count abnormality is detected by the abnormality detecting unit 68, a coin count value counted by the count processing unit 27 is cleared if the normal counting mode has been selected, and the coin count value counted by the count processing unit 27 is held if the continuous counting mode has been selected.

A function to perform a second count operation in which, during count processing by the count processing unit 27, in a case where a count abnormality is detected by the abnormality detecting unit 68, the display unit 13 is caused to display whether continuous counting is to be performed, and when the operation unit 14 instructs not to perform continuous counting, the coin count value counted by the count processing unit 27 is cleared, and when the operation unit 14 instructs continuous counting, the coin count value counted by the count processing unit 27 is held.

Either the function to perform the first count operation or the function to perform the second count operation is selected.

A function to stop count processing of the count processing unit 27 if an abnormality is detected by the abnormality detecting unit 68 when either the normal counting mode or the continuous counting mode is selected.

A function to restart count processing of the count processing unit 27 in response to an operation of the start button of the operation unit 14 when the continuous counting mode is selected.

A function to cause the processing speed of the count processing unit 27 when the continuous counting mode is selected to be higher than the processing speed of the count processing unit 27 when the normal counting mode is selected.

A function to cause the printing unit 66 to issue a receipt on which the printing unit prints that the continuous counting mode is selected is printed after count processing in the continuous counting mode is finished.

A function to cause the wrapping processing unit 28 to eject wrapped coins consisting of an abnormal number of coins when the normal wrapping mode is selected, and to cause the wrapping processing unit 28 to continue wrapping processing when the continuous wrapping mode is selected in a case where wrapped coins consisting of an abnormal number of coins is detected by the abnormality detecting unit 68.

A function to disable detection caused by the abnormality detecting unit 68 when the continuous wrapping mode is selected.

A function to cause the wrapping paper printing unit 19 to print that the continuous wrapping mode is selected on the wrapping paper for wrapping coins in the continuous wrapping mode.

Next, operations and effects of the present embodiment will be described.

Figure 5:
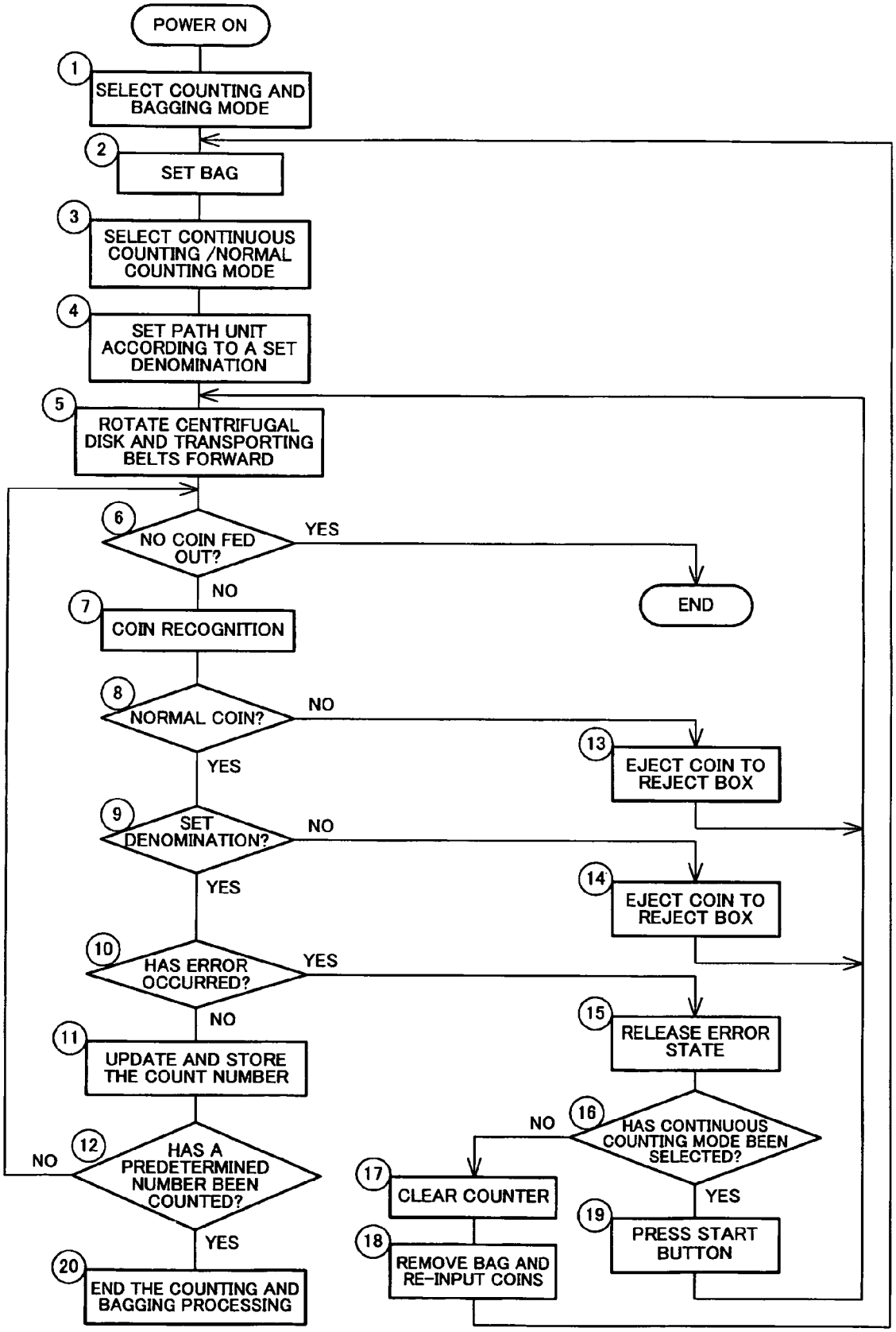
FIG. 5 is a flowchart showing an example of count processing of the same coin handling machine.

First, as an example of count processing, an example of the first count operation will be described with reference to the flowchart of FIG. 5.

In a state where the power of the coin wrapping machine is on, a counting and bagging mode is selected on the operation unit 14 (Step 1), and a bag is fitted to the bag fitting portion 58 (Step 2). Then, coins to be counted are input into the hopper 12.

On the operation unit 14, either the normal counting mode or the continuous counting mode is selected (Step 3), and a denomination of coins to be counted is selected.

According to the selected denomination, the path width of the path unit 23 is automatically adjusted (Step 4).

The centrifugal disks 21 and 22 and the transporting belts 39 and 40 are driven to rotate forward (Step 5), a counting and bagging operation is started.

Coins input into the hopper 21 are supplied by a predetermined amount each from the centrifugal disk 21 to the centrifugal disk 22, the coins are fed one by one from the centrifugal disk 22 to the path unit 23, and the coins in the path unit 23 are transported by the transporting belts 39 and 40.

When coins no longer remain in the hopper 12 and on the centrifugal disks 21 and 22 and coins are no longer fed out to the path unit 23, the process is ended (Step 6).

Coins being transported in the path unit 23 are recognized by the recognition unit 42 (Step 7).

As a result of recognition, when a coin is a normal coin and is of a set denomination (Steps 8 and 9) and no error occurs (Step 10), the coin is detected by the count sensor 43 and the count number is updated and stored (Step 11). The coin is ejected from the terminal end of the path unit 23 and stored in a bag through the receiving chute 57 and the bag fitting portion 58.

Thus, a counting and bagging operation is continued until a predetermined number is counted (Step 12) or no coins remain.

As a result of recognition by the recognition unit 42, a coin which is not recognized as a normal coin (Step 8: NO) or a coin that is not of a set denomination is recognized (Step 9: NO), the stopper 44 is made to protrude into the path to stop the coin, and coins preceding the coin are ejected from the terminal end of the path unit 23. Thereafter, the stopper 44 is retracted from the inside of the path, the coin is transported by the transporting belts 39 and 40, and at a timing at which the coin has passed through the stopper 44, the stopper 44 is made to protrude into the path to stop coins succeeding the coin, and the transporting belts 39 and 40 are stopped to stop the coin below the transporting belt 40. Then, the transporting belt 39 and the centrifugal disk 22 are rotated reversely to return coins succeeding the coin to the portion on the centrifugal disk 22. Subsequently, by driving the path width adjusting motor 65, the path width between the movable path members 37 and 38 is widened to the maximum. Subsequently, the stopper 44 is retracted from the inside of the path, and by driving the transporting belts 39 and 40 to rotate reversely, the coin is ejected by the ejecting hole 41 and sent into a reject box arranged inside the machine body 11 (Steps 13 and 14). Thereafter, the transporting belts 39 and 40 are stopped, the movable path members 37 and 38 are returned to the positions of the original path width, and then the transporting belts 39 and 40 are driven to rotate forward and count processing is restarted.

When the abnormality detecting unit 68 detects such an error as in the case where coin jam occurs or a coin which is not recognized as a normal coin, a coin which is not of a set denomination, or a coin after a predetermined number of coins are counted could not be stopped by the stopper 44 (Step 10: YES), the count processing is stopped.

In the case of coin jam, after the error state is released (Step 15), the selected mode is checked (Step 16).

If the normal counting mode has been selected (Step 16: NO), the coin count value is cleared (Step 17), the bag is removed from the bag fitting portion 58, and coins in the bag are input into the hopper 12 again (Step 18). Thereafter, the count processing is restarted.

If the continuous counting mode has been selected (Step 16: YES), the coin count value is held, and in response to an operation of the start button of the operation unit 14 (Step 19), the count processing is restarted.

Then, after a predetermined number of coins are counted and stored in the bag (Step 12: YES), the count processing in the counting and bagging mode is ended (Step 20).

Thus, in a case where a count abnormality is detected during count processing, when the normal counting mode is selected, the coin count value is cleared to prevent a quantity error, and when the continuous counting mode is selected, the coin count value is held, and continuous processing is enabled even if a count error occurs, so that the handling efficiency is improved, and accordingly, diverse demands of the market can be satisfied.

When either the normal counting mode or the continuous counting mode is selected, if an abnormality is detected, the count processing can be stopped and the abnormality can be confirmed.

When the continuous counting mode is selected, the count processing can be easily restarted by operation of the start button of the operation unit 14.

The processing speed of the count processing unit when the continuous counting mode is selected may be made higher than the processing speed of the count processing unit when the normal counting mode is selected, and in this case, the handling efficiency can be improved.

After the count processing in the continuous counting mode is finished, by issuing a receipt on which the printing unit prints that the continuous counting mode is selected by the printing unit 66, the receipt can be attached to the counted coins, and the possibility of a quantity error can be indicated.

Figure 6:
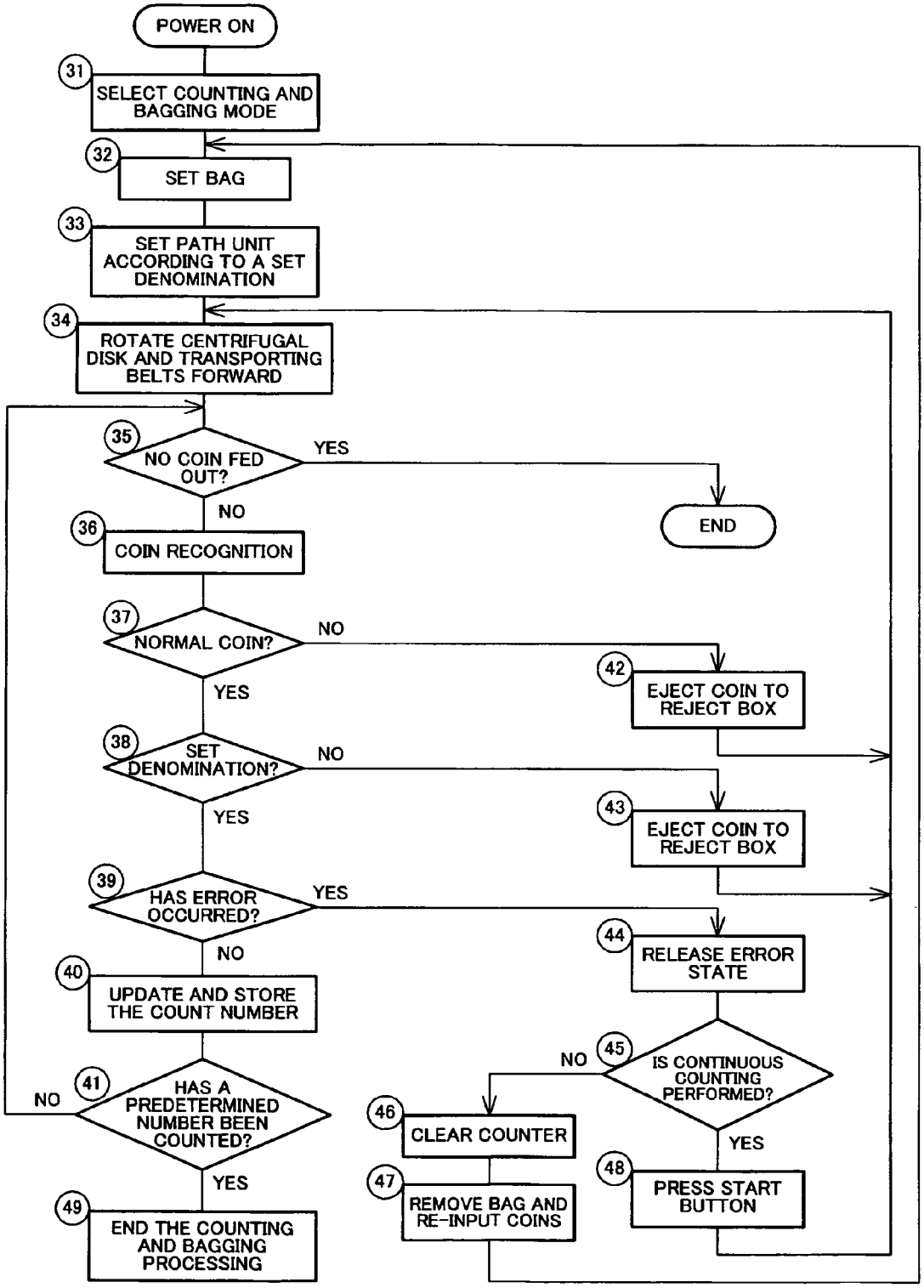
FIG. 6 is a flowchart showing another example of count processing of the same coin handling machine.

Next, as an example of count processing, the second count operation will be described with reference to the flowchart of FIG. 6.

In a state where the power of the coin wrapping machine is on, the counting and bagging mode is selected on the operation unit 14 (Step 31), and a bag is fitted to the bag fitting portion 58 (Step 32). Then, coins to be counted are input into the hopper 12.

On the operation unit 14, a denomination of coins to be counted is selected. According to this selected denomination, the path width of the path unit 23 is automatically adjusted (Step 33).

The centrifugal disks 21 and 22 and the transporting belts 39 and 40 are driven to rotate forward (Step 34), and a counting and bagging operation is started.

Coins input into the hopper 12 are supplied by a predetermined amount each from the centrifugal disk 21 to the centrifugal disk 22, the coins are fed out one by one from the centrifugal disk 22 to the path unit 23, and the coins in the path unit 23 are transported by the transporting belts 39 and 40.

When coins no longer remain in the hopper 12 and on the centrifugal disks 21 and 22 and coins are no longer fed out to the path unit 23, the process is ended (Step 35).

Coins being transported in the path unit 23 are recognized by the recognition unit 42 (Step 36).

As a result of recognition, when a coin is a normal coin and is of a set denomination (Steps 37 and 38) and no error occurs (Step 39), the coin is detected by the count sensor 43 and the count number is updated and stored (Step 40). The coin is ejected from the terminal end of the path unit 23 and stored in the bag through the receiving chute 57 and the bag fitting portion 58.

Thus, the counting and bagging operation is continued until a predetermined number of coins are counted (Step 41) or coins no longer remain.

As a result of recognition by the recognition unit 42, when a coin is not recognized as a normal coin (Step 37: NO) or a coin which is not of a set denomination is recognized (Step 38: NO), the coin is stopped by protruding the stopper 44 to the inside of the path, and coins preceding the coin are ejected from the terminal end of the path unit 23. Thereafter, the stopper 44 is from the inside of the path, the coin is transported by the transporting belts 39 and 40, and at a timing at which the coin passes through the stopper 44, coins succeeding the coin are stopped by protruding the stopper 44 to the inside of the path, and the coin is stopped below the transporting belt 40 by stopping the transporting belts 39 and 40. Then, the transporting belt 39 and the centrifugal disk 22 are rotated reversely to return coins succeeding the coin to the portion on the centrifugal disk 22. Subsequently, the path width between the movable path members 37 and 38 is widened to the maximum by driving the path width adjusting motor 65. Subsequently, the stopper 44 is retracted from the inside of the path, and by driving the transporting belts 39 and 40 to rotate reversely, the coin is ejected by the ejecting hole 41 and sent into the reject box arranged inside the machine body 11 (Steps 42 and 43). Thereafter, the transporting belts 39 and 40 are stopped and the movable path members 37 and 38 are returned to the positions of the original path width, and then the transporting belts 39 and 40 are driven to rotate forward and count processing is restarted.

When the abnormality detecting unit 68 detects such an error as in the case where coin jam occurs or a coin which was not recognized as a normal coin, a coin which is not of a set denomination, or a coin after a predetermined number of coins are counted could not be stopped by the stopper 44 (Step 39: YES), the count processing is stopped.

In the case of coin jam, after the error state is released (Step 44), the display unit 13 displays whether continuous counting is to be performed.

When an operation not to perform continuous counting is performed on the operation unit 14 (Step 45: NO), the coin count value is cleared (Step 46), the bag is removed from the bag fitting portion 58, and coins in the bag are input into the hopper 12 again (Step 47). Thereafter, the count processing is restarted.

When an operation to perform continuous counting is performed on the operation unit 14 (Step 45: YES), the coin count value is held, and by an operation of the start button of the operation unit 14 (Step 48), the count processing is restarted.

Then, when a predetermined number of coins are counted and stored in the bag (Step 41: YES), the count processing in the counting and bagging mode is ended (Step 49).

Thus, when a count abnormality is detected during count processing, the display unit 13 is caused to display whether continuous counting is to be performed, and when the operation unit 14 instructs not to perform continuous counting, the coin count value is cleared and a quantity error can be prevented, and when the operation unit 14 instructs to perform continuous counting, the coin count value is held and continuous processing is enabled even if a count error occurs, so that the handling efficiency is improved, and accordingly, diverse demands of the market can be satisfied.

Figure 7:
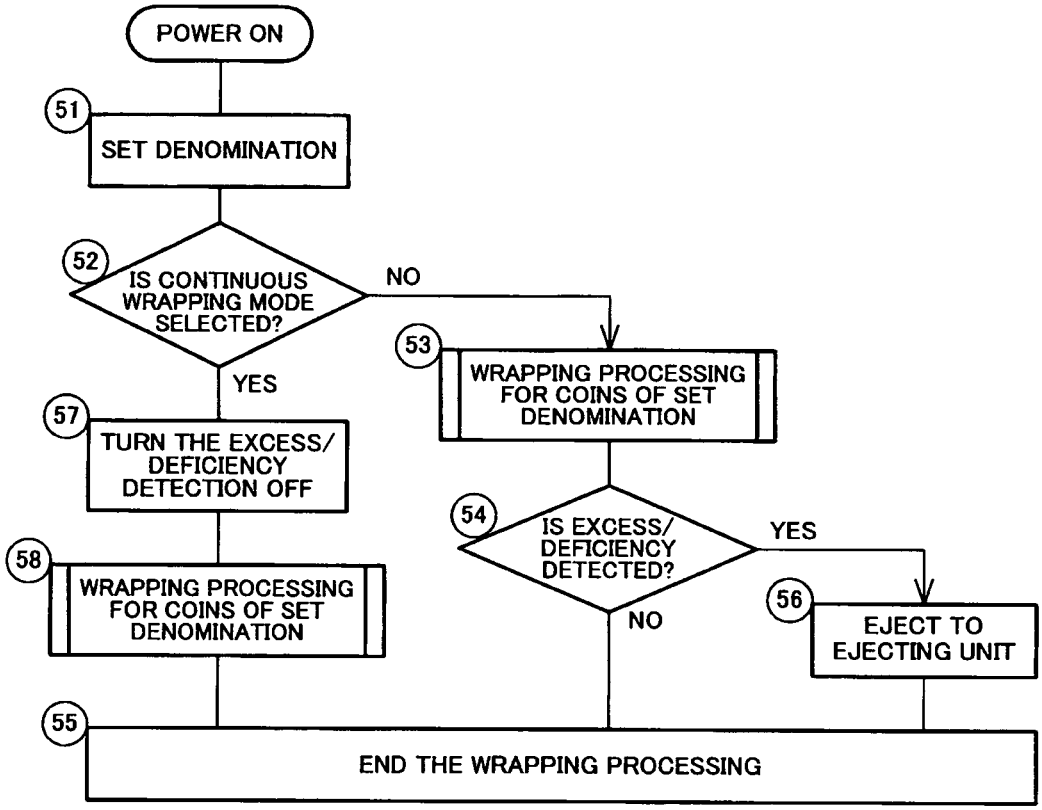
FIG. 7 is a flowchart showing an example of wrapping processing of the same coin handling machine.

Next, an example of wrapping processing will be described with reference to the flowchart of FIG. 7.

In a state where the power of the coin wrapping machine is on, on the operation unit 14, a denomination of coins to be wrapped is set (Step 51), and either the normal wrapping mode or the continuous wrapping mode is selected.

If the normal wrapping mode has been selected (Step 52: NO), wrapping processing for coins of the set denomination is performed (Step 53), it is checked whether the number of wrapped coins is excessive/deficient (Step 54), and when the number is not excessive/deficient (Step 54: NO), the wrapped coins are dispensed to the wrapped coin dispensing unit 16 and the wrapping processing is ended (Step 55), and when the number is excessive/deficient (Step 54: YES), the wrapped coins are ejected to the ejecting unit 17 (Step 56).

If the continuous wrapping mode has been selected (Step 52: YES), the detection of excess/deficiency of the number of wrapped coins is disabled, that is, detection by the abnormality detecting unit 68 is disabled (Step 57), and wrapping processing for the coins of the set denomination is performed (Step 58), the wrapped coins are dispensed to the wrapped coin dispensing unit 16 and the wrapping processing is ended (Step 55).

Figure 8:
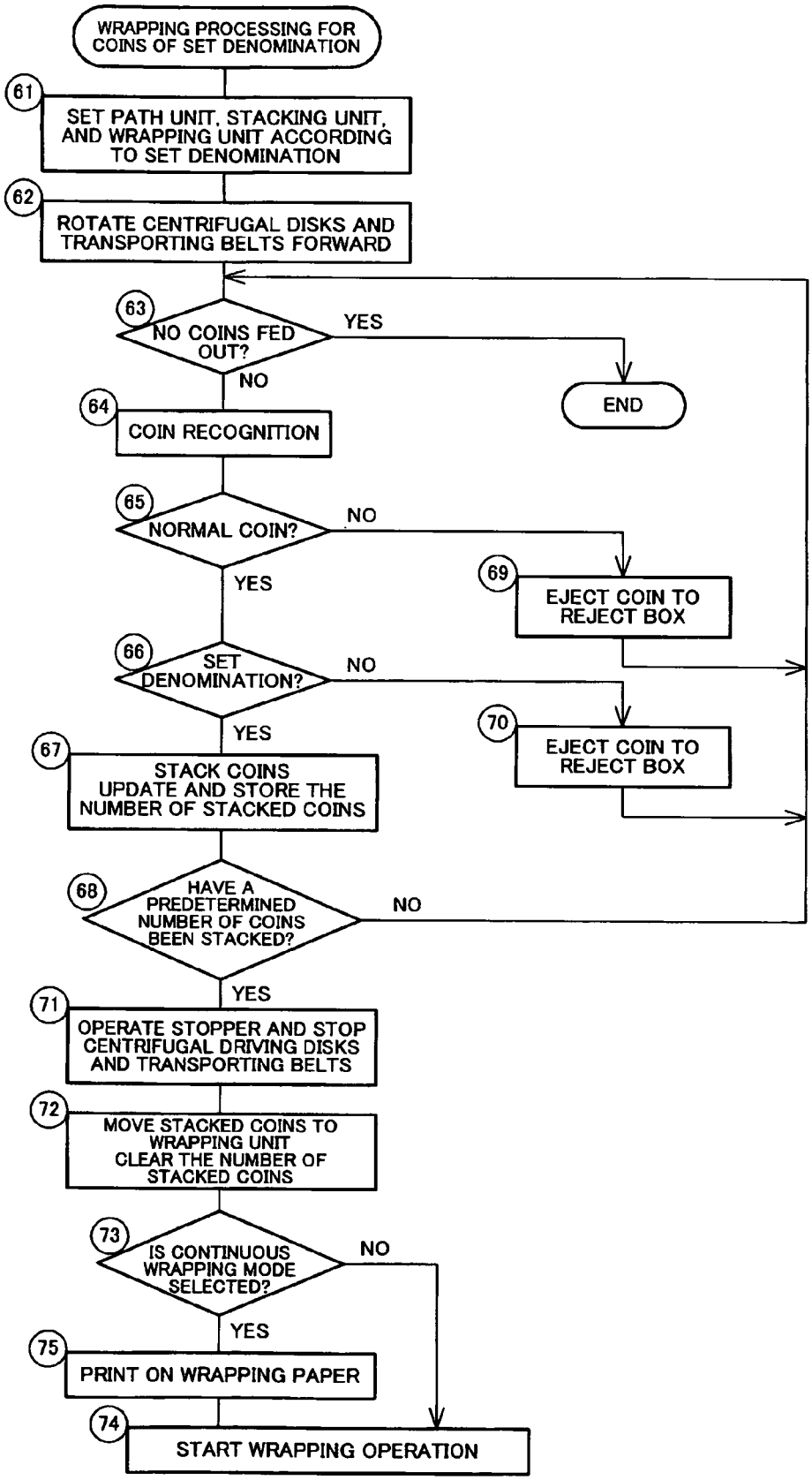
FIG. 8 is a flowchart showing wrapping processing for coins of a set denomination in the same coin handling machine of FIG. 7.

Next, an example of wrapping processing for coins of a set denomination in Steps 53 and 58 will be described with reference to the flowchart of FIG. 8.

According to a denomination set on the operation unit 14, the path unit 23, the stacking unit 24, and the wrapping unit are automatically adjusted (Step 61).

The centrifugal disks 21 and 22 and the transporting belts 39 and 40 are driven to rotate forward (Step 62), and wrapping processing is started.

Coins input in the hopper 12 are supplied by a predetermined amount each from the centrifugal disk 21 to the centrifugal disk 22, and the coins are fed out one by one from the centrifugal disk 22 to the path unit 23, and the coins in the path unit 23 are transported by the transporting belts 39 and 40.

When no coins remain in the hopper 12 and on the centrifugal disks 21 and 22 and no coins are fed out to the path unit 23, the process is ended (Step 63: YES).

The coins being transported in the path unit 23 are recognized by the recognition unit 42 (Step 64).

As a result of recognition, when a coin is a normal coin and is of a set denomination (Steps 65 and 66), the coin is detected by the count sensor 43 and the number of stacked coins in the stacking unit 24 is updated and stored (Step 67). The coin is ejected to the stacking unit 24 from the terminal end of the path unit 23, and stacked in the stacking unit 24.

This coin stacking operation in the stacking unit 24 is continued until a predetermined number of coins are stacked (Step 68) or coins no longer remain.

As a result of recognition by the recognition unit 42, when a coin is not recognized as a normal coin (Step 65: NO) or a coin which is not of the set denomination is recognized (Step 66: NO), the coin is stopped by protruding the stopper 44 into the path, and coins preceding the coin are ejected from the terminal end of the path unit 23. Thereafter, the stopper 44 is retracted from the inside of the path, and the coin is transported by the transporting belts 39 and 40, and at a timing at which the coin passes through the stopper 44, coins succeeding the coin are stopped by protruding the stopper 44 to the inside of the path, and the coin is stopped below the transporting belt 40 by stopping the transporting belts 39 and 40. Then, the transporting belt 39 and the centrifugal disk 22 are rotated reversely to return coins succeeding the coin to the portion on the centrifugal disk 22. Subsequently, the path width between the movable path members 37 and 38 is widened to the maximum by driving the path width adjusting motor 65. Subsequently, the stopper 44 is retracted from the inside of the path, and by rotating the transporting belts 39 and 40 reversely, the coin is ejected by the ejecting hole 41 and sent into the reject box arranged inside the machine body 11 (Steps 69 and 70). Thereafter, the transporting belts 39 and 40 are stopped, and after the movable path members 37 and 38 are returned to the positions of the original path width, the transporting belts 39 and 40 are driven to rotate forward and count processing is restarted.

Then, when a predetermined number of coins are counted, that is, when the predetermined number of coins are stacked in the stacking unit 24 (Step 68: YES), coins after the predetermined number of coins are stopped by the stopper 44, and the centrifugal disks 21 and 22 and the transporting belts 39 and 40 are stopped (Step 71).

The predetermined number of stacked coins stacked in the stacking unit 24 is moved to the wrapping unit below, and the stored number of stacked coins is cleared (Step 72).

Then, it is checked whether the continuous wrapping mode is selected (Step 73).

When the normal wrapping mode is selected (Step 73: NO), in the wrapping unit, a wrapping operation to wrap the stacked coins in the wrapping paper is started (Step 74).

When the continuous wrapping mode is selected (Step 73: YES), in the wrapping unit, an indication that the continuous wrapping mode is selected is printed by the wrapping paper printing unit 19 (Step 75), and a wrapping operation to wrap the stacked coins with the wrapping paper is started (Step 74).

Thus, when wrapped coins consisting of an abnormal number of coins are detected, if the normal wrapping mode has been selected, the wrapped coins are ejected and a quantity error can be prevented, and if the continuous wrapping mode has-been selected, the wrapping processing is continued, so that the handling efficiency is improved, and accordingly, diverse demands of the market can be satisfied.

When the continuous wrapping mode is selected, the detection by the abnormality detecting unit is disabled, and wrapping processing can be continued.

By printing that the continuous wrapping mode is selected on the wrapping paper for wrapping coins in the continuous wrapping mode by the wrapping paper printing unit 19, the possibility of an abnormal number of wrapped coins can be indicated.

Industrial Applicability

The present invention is applicable to coin handling machines such as a coin counting machine which counts coins and a coin wrapping machine which wraps coins.

The invention claimed is:

1. A coin handling machine comprising:

a count processing unit which counts coins;

an abnormality detecting unit which detects a count abnormality in the count processing unit;

an operation unit which selects either a normal counting mode or a continuous counting mode; and a control unit which, in a case where a count abnormality is detected by the abnormality detecting unit during count processing by the count processing unit, causes the count processing unit to clear a coin count value counted by the count processing unit when the normal counting mode is selected, and causes the count processing unit to hold a coin count value counted by the count processing unit when a count abnormality is detected and that continues the count processing when the continuous counting mode is selected.

2. The coin handling machine according to claim 1, wherein the control unit causes the count processing unit to stop count processing when an abnormality is detected by the abnormality detecting unit when either the normal counting mode or the continuous counting mode is selected.

3. The coin handling machine according to claim 1, wherein the operation unit includes a start button, and the control unit causes the count processing unit to restart count processing in response to an operation of the start button when the continuous counting mode is selected.

4. The coin handling machine according to claim 1, wherein the control unit causes a processing speed of the count processing unit when the continuous counting mode is selected to be higher than a processing speed of the count processing unit when the normal counting mode is selected.

5. The coin handling machine according to claim 1, comprising:

a printing unit which issues a receipt, wherein the control unit causes the printing unit, after count processing in the continuous counting mode is finished, to issue a receipt on which the printing unit prints that the continuous counting mode is selected.

6. A coin handling machine comprising:

a count processing unit which counts coins;

an abnormality detecting unit which detects a count abnormality in the count processing unit;

a display unit which displays whether continuous counting is to be performed;

an operation unit which instructs whether continuous counting is to be performed; and a control unit which, in a case where a count abnormality is detected by the abnormality detecting unit during count processing by the count processing unit, causes the display unit to display whether continuous counting is to be performed, and causes the count processing unit to clear a coin count value counted by the count processing unit when continuous counting is not instructed by the operation unit, and causes the count processing unit to hold a coin count value counted by the count processing unit when a count abnormality is detected and that continues the count processing when the continuous counting is instructed by the operation unit.

7. A coin handling machine comprising:

a wrapping processing unit which wraps coins;

an abnormality detecting unit which detects an abnormal number of wrapped coins wrapped by the wrapping processing unit;

an operation unit which selects either a normal wrapping mode or a continuous wrapping mode; and a control unit which, in a case where an abnormal number of wrapped coins is detected by the abnormality detecting unit, causes the wrapping processing unit to eject the wrapped coins consisting of the abnormal number of coins when the normal wrapping mode is selected, and causes the wrapping processing unit to continue wrapping processing when the continuous wrapping mode is selected.

8. The coin handling machine according to claim 7, wherein the control unit disables detection of the abnormality detecting unit when the continuous wrapping mode is selected.

9. The coin handling machine according to claim 7, comprising:

a wrapping paper printing unit which performs printing on wrapping paper for wrapping the coins, wherein the control unit causes the wrapping paper printing unit to print that the continuous wrapping mode is selected, on the wrapping paper for wrapping coins in the continuous wrapping mode.

10. A coin handling machine comprising:

a count processing unit which counts coins;

an abnormality detecting unit which detects a count abnormality in the count processing unit;

a display unit which displays whether continuous counting is to be performed;

an operation unit which instructs whether continuous counting is to be performed; and a control unit which, in a case where a count abnormality is detected by the abnormality detecting unit during count processing by the count processing unit, causes the display unit to display whether continuous counting is to be performed, and causes the count processing unit to clear a coin count value counted by the count processing unit when continuous counting is not instructed by the operation unit, and causes the count processing unit to hold a coin count value counted by the count processing unit when the continuous counting is instructed by the operation unit.

* * * * *